US008950189B2

(12) United States Patent
Snyder

(10) Patent No.: US 8,950,189 B2
(45) Date of Patent: Feb. 10, 2015

(54) GAS TURBINE ENGINE STAGED FUEL INJECTION USING ADJACENT BLUFF BODY AND SWIRLER FUEL INJECTORS

(75) Inventor: Timothy S. Snyder, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 832 days.

(21) Appl. No.: 13/170,406

(22) Filed: Jun. 28, 2011

(65) Prior Publication Data

US 2013/0000311 A1 Jan. 3, 2013

(51) Int. Cl.

| | |
|---|---|
| ***F02C 7/228*** | (2006.01) |
| ***F23R 3/34*** | (2006.01) |
| *F23R 3/14* | (2006.01) |

(52) U.S. Cl.

CPC . *F23R 3/343* (2013.01); *F23R 3/14* (2013.01); *F23D 2900/00015* (2013.01)

USPC ..... 60/749; 60/746; 60/748

(58) Field of Classification Search

USPC ..... 60/737, 740, 746, 748, 749

See application file for complete search history.

(56) References Cited

U.S. PATENT DOCUMENTS

| | | | | |
|---|---|---|---|---|
| 5,099,644 | A * | 3/1992 | Sabla et al. | 60/207 |
| 5,142,858 | A * | 9/1992 | Ciokajlo et al. | 60/733 |
| 5,207,064 | A * | 5/1993 | Ciokajlo et al. | 60/737 |
| 5,402,634 | A | 4/1995 | Marshall | |
| 5,551,869 | A | 9/1996 | Brais et al. | |
| 5,943,866 | A | 8/1999 | Lovett et al. | |
| 6,176,087 | B1 | 1/2001 | Snyder et al. | |
| 6,295,801 | B1 * | 10/2001 | Burrus et al. | 60/776 |
| 6,481,209 | B1 * | 11/2002 | Johnson et al. | 60/746 |
| 7,412,833 | B2 | 8/2008 | Widener | |
| 7,621,132 | B2 | 11/2009 | Cornwell et al. | |
| 2002/0112482 | A1 | 8/2002 | Johnson et al. | |
| 2009/0151360 | A1 * | 6/2009 | Burd et al. | 60/748 |
| 2010/0050644 | A1 | 3/2010 | Pidcock et al. | |
| 2011/0185735 | A1 * | 8/2011 | Snyder | 60/746 |

OTHER PUBLICATIONS

European Search Report dated Oct. 22, 2012, from EP Appl. 12173923.9-2301.

* cited by examiner

*Primary Examiner* — Ehud Gartenberg

*Assistant Examiner* — Lorne Meade

(74) *Attorney, Agent, or Firm* — Carlson, Gaskey & Olds, PC

(57) ABSTRACT

A fuel injection array for a gas turbine engine includes a plurality of bluff body injectors and a plurality of swirler injectors. A control operates the plurality of bluff body injectors and swirler injectors such that bluff body injectors are utilized without all of the swirler injectors at least at low power operation. The swirler injectors are utilized at higher power operation.

11 Claims, 3 Drawing Sheets

GAS TURBINE ENGINE STAGED FUEL INJECTION USING ADJACENT BLUFF BODY AND SWIRLER FUEL INJECTORS

This invention was made with government support under Contract No. NNC08CA92C by NASA. The Government has certain rights in this invention.

BACKGROUND

This application relates to a fuel injection apparatus and method for use in a gas turbine engine, where both bluff body injectors, and swirler injectors are utilized in stages.

Gas turbine engines are known, and typically include a compressor compressing air and delivering the air to be mixed with fuel in a combustion chamber, and then ignited. The amount and ratio of fuel and air which are mixed and ignited vary. At low power, a fuel/air ratio is low, and at higher power, such as take-off and cruise, the fuel/air ratio is higher. It is known to control a group of injectors in stages, with some injectors not being utilized during low power operation, and then utilized at higher power operation.

Fuel injectors are known which utilize a swirler concept. In a swirler concept, the fuel is injected into a swirling chamber, and mixed with air prior to combustion.

Another type of injector is a so-called bluff body injector, which directly injects fuel into a combustion chamber.

SUMMARY

A fuel injection array for a gas turbine engine includes a plurality of bluff body injectors and a plurality of swirler injectors. A control operates the plurality of bluff body injectors and swirler injectors such that bluff body injectors are utilized without all of the swirler injectors at least at low power operation. The swirler injectors are utilized at higher power operation.

These and other features of the present invention can be best understood from the following specification and drawings, of which the following is a brief description.

DETAILED DESCRIPTION

Figure 1:
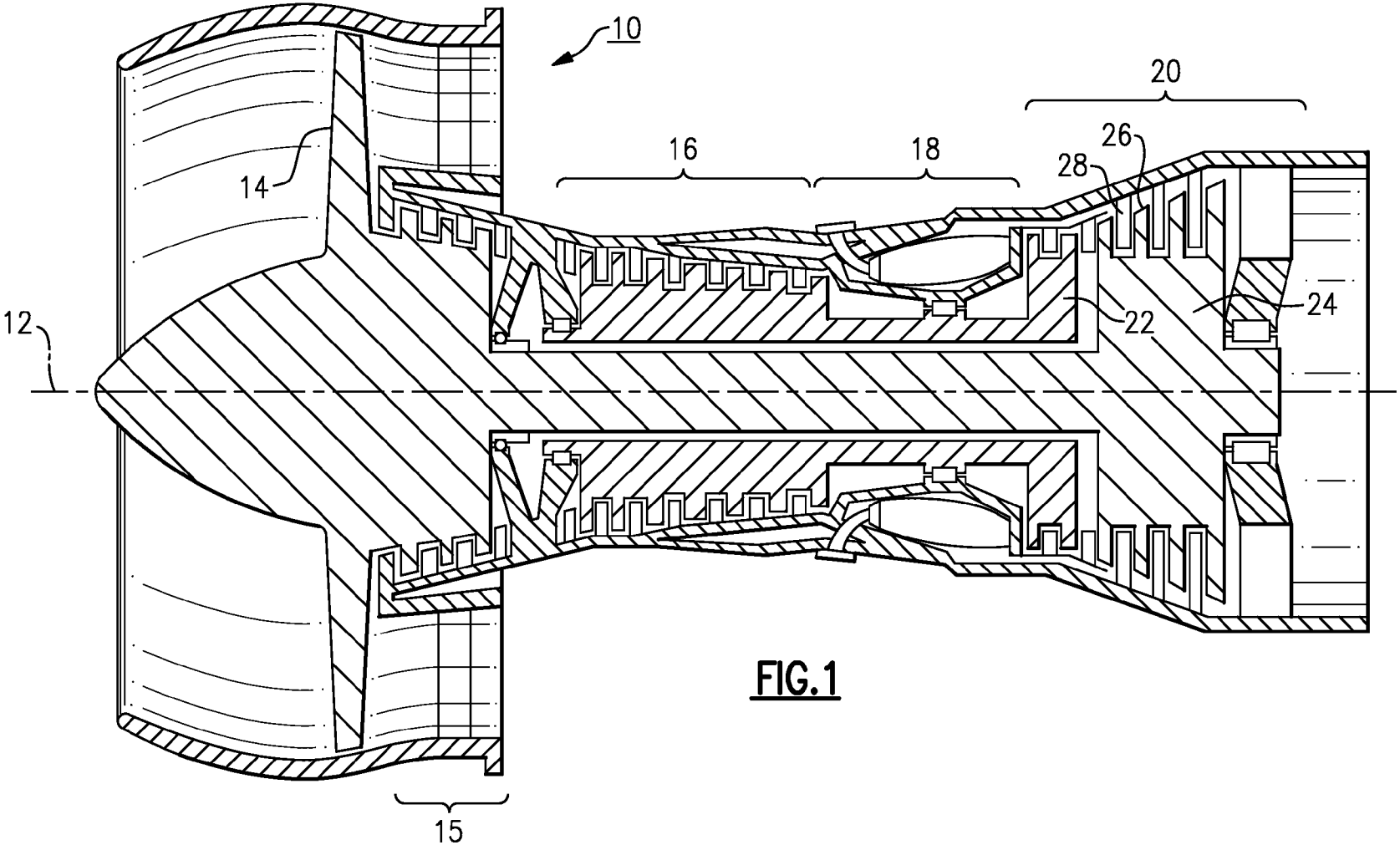
FIG. 1 schematically shows a gas turbine engine.

A gas turbine engine 10, such as a turbofan gas turbine engine, circumferentially disposed about an engine centerline, or axial centerline axis 12 is shown in FIG. 1. The engine 10 includes a fan 14, compressor sections 15 and 16, a combustion section 18 and a turbine section 20. As is well known in the art, air compressed in the compressor 15/16 is mixed with fuel and burned in the combustor 18 and expanded in turbine 20. The turbine 20 includes rotors 22 and 24, which rotate in response to the expansion. The turbine 20 comprises alternating rows of rotary airfoils or blades 26 and static airfoils or vanes 28. In fact, this view is quite schematic, and blades 26 and vanes 28 are actually removable. It should be understood that this view is included simply to provide a basic understanding of the sections in a gas turbine engine, and not to limit the invention. This invention extends to all types of turbine engines for all types of applications.

Figure 2:
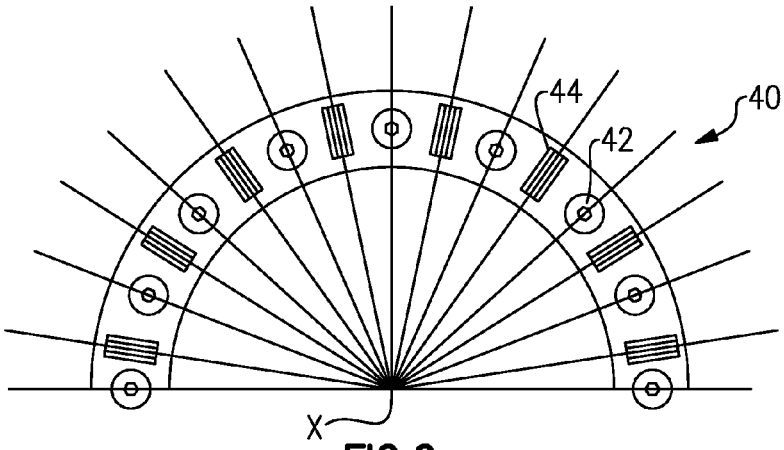
FIG. 2 schematically shows a fuel injector array according to this application.

FIG. 2 shows a fuel injection array 40 which can be utilized with the combustor 18 in a gas turbine engine. As shown, a plurality of bluff body injectors 44 are circumferentially interspaced with swirler injectors 42. In one embodiment, there may be 16 of each type of injectors spaced around a central axis X of the gas turbine engine. Of course, other numbers can be used.

Figure 3:
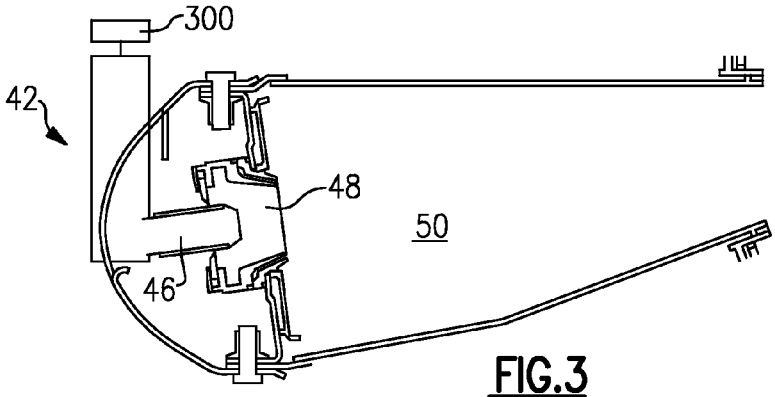
FIG. 3 shows one portion of the FIG. 2 array.

Swirlers are generally known, and one such device is shown in FIG. 3. As shown in FIG. 3, the swirler injector 42 includes a fuel injection pipe 46 injecting fuel into a swirler body 48. Swirlers are designed to provide air to mix with the fuel, such that the fuel and air are well mixed when they reach a combustion chamber 50. As shown, igniter 81 ignites the mixed fuel and air in the combustion chamber 50.

Figure 4:
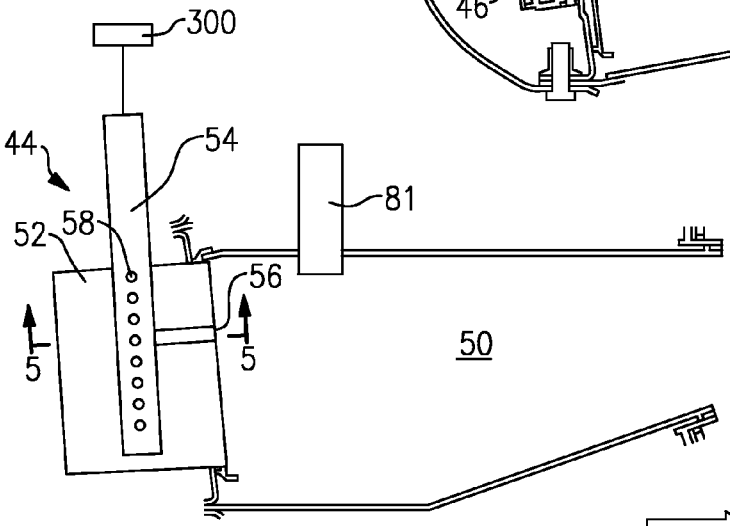
FIG. 4 shows another portion.
Figure 5:
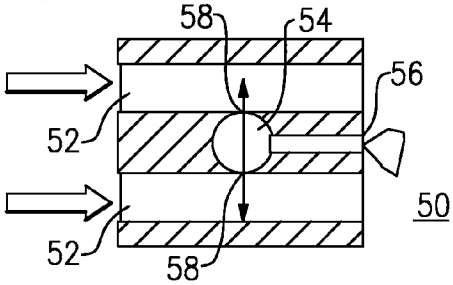
FIG. 5 is a cross-sectional view along line 5-5 of FIG. 4.

FIG. 4 shows a bluff body injector 44. A tube 54 receives fuel and directs the fuel outwardly to a pilot port 56. Pilot opening 56 generally injects fuel into the combustion chamber 50. The pipe 54 also has a plurality of openings 58 which inject fuel into an air flow passages 52. As can be appreciated from FIG. 5, the air flow passages 52 may be on both sides of the pipe 54, with the injection 58 moving into the air flow passages 52 and being mixed prior to reaching the combustion chamber 50. As shown, the pilot opening 56 injects the fuel directly into the combustion chamber 50.

Figure 6:
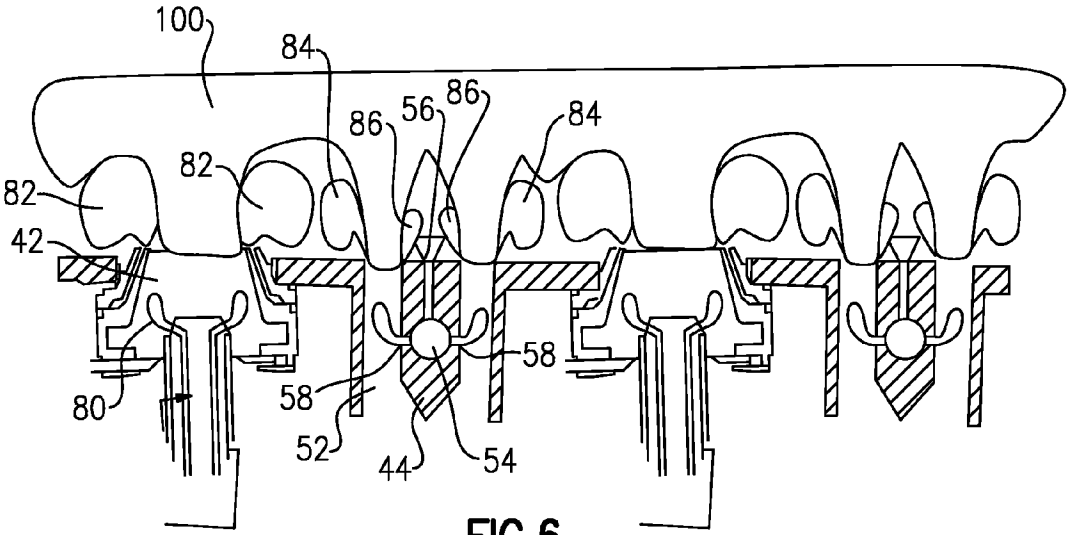
FIG. 6 shows the combined operation of the FIG. 2 array.

FIG. 6 shows a well mixed fuel/air zone which is provided when all of the injectors 42, 44 are being utilized. As shown, the pipes 54 have pilot openings 56 injecting fuel and having a recirculating area 86. The pilot opening 56 provides a very stable and reliable flame.

Fuel is injected outwardly through ports 58 and into the air flow passages 52 creating a portion of well mixed zone 100. The flame is held in the zones 86 and 84 which are relatively low velocity regions of the flame.

The swirler 42 is shown creating the other portion of well mixed fuel/air zone 100. The flame is held in zones 82 from the injected fuel 80.

Returning to FIGS. 3 and 4, a control 300 is shown schematically associated with the pipe 54 and the fuel injector 46. The control 300 is operable to supply or block supply of fuel to the pipe 54 and the injector 46.

The injector array 40 is utilized in stages. Under low power operation, a first stage defined by the pilot openings 56 is utilized in combination with a second stage which is defined by the flow through the ports 58. Thus, at idle, taxi, or sub-cruise operation, fuel is blocked through the swirlers 42 by the control 300.

At take-off and cruise, a third stage is utilized in combination with the first two stages. The third stage includes the swirlers 42.

The bluff body injector is particularly advantageous at lower power operation, as it provides the stable and reliable flame. A swirler is not as efficient at lower volume flow.

On the other hand, using the several types of injectors at higher power provides benefits in that the swirlers provide excellent mixing. Further, the second stage injection would also provide good mixing. The use of the several distinct types of injection results in an overall combustion pattern that is not a coherent structure. If only a single type of injector is utilized, then the resultant combustion could act as a coherent structure, and result in an audio tone, which would be undesirable.

Figure 7:
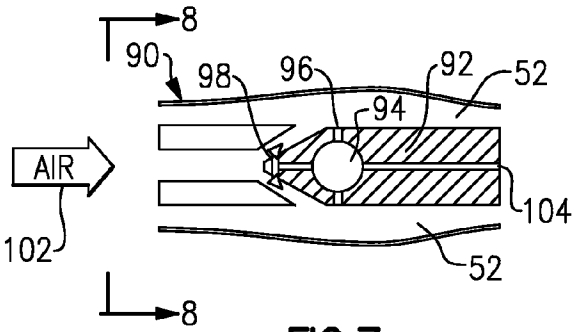
FIG. 7 shows an alternative embodiment.

FIG. 7 shows another embodiment bluff body 90. As shown, the fluid pipe 92 includes a central passage 94 leading to the pilot opening 104. Side ports 96 operate as in earlier embodiments. Additional ports 98 supply fuel outwardly at a location upstream from the ports 96. Air flow 102 mixes with all of the fuel from the ports 98 and 96, and then penetrates and mixes into air passages 52 to create a well mixed fuel/air zone 100.

Figure 8:
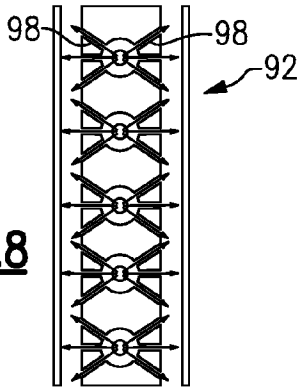
FIG. 8 is a view along line 8-8 of FIG. 7.

As can be appreciated from FIG. 8, there are a great number of ports 98, ensuring increased mixing of the fuel with air 102 and 52.

The use of the bluff body injector, and in particular the pilot opening ensures efficient and reliable combustion at the lower power operations On the other hand, the use of the swirler injectors at higher power operation ensure reduced smoke, or NOx emissions.

At lower power operation, the amount of fuel flow in stage 2 is much greater than the amount of fuel flow from stage 1. At mid to high power operation, the amount of fuel flow from stage 3 can be optimized for emissions and combustion dynamics. The amount of fuel flow from stage 1.

Figure 9:
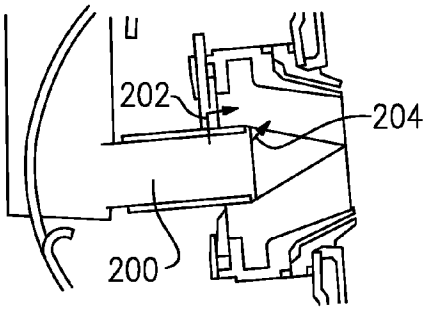
FIG. 9 shows another alternative embodiment.

FIG. 9 shows an embodiment 200 of a swirler wherein a first supply of fuel 202 extends to a location radially outwardly of the main injection point 204 to increase the level of fuel/air mixing. Air mixes with this fuel in the swirler body, as known.

Although embodiments of this invention have been disclosed, a worker of ordinary skill in this art would recognize that certain modifications would come within the scope of this invention. For that reason, the following claims should be studied to determine the true scope and content of this invention.

What is claimed is:

1. A fuel injection array for a gas turbine engine comprising:

a plurality of bluff body injectors and a plurality of swirler injectors;

a control for operating said plurality of bluff body injectors and said swirler injectors such that said bluff body injectors are utilized without all of the swirler injectors at least at low power operation, and said swirler injectors are utilized at higher power operation; and said bluff body injectors include a central flow passage leading to a pilot port communicating fuel directly into a combustion chamber, said bluff body injectors also communicate fuel into locations upstream of the combustion chamber where the fuel is mixed with air prior to it reaching the combustion chamber, a fuel supply line leads into said central flow passage, and ports extend from said fuel supply line to locations on opposed sides of said central flow passage to intermix with air flowing along said opposed sides.

2. The fuel injection array as set forth in claim 1, wherein said bluff body injectors are utilized along with said swirler injectors at higher power operation.

3. The fuel injection array as set forth in claim 1, wherein fuel is directed in a plurality of directions from said ports.

4. The fuel injection array as set forth in claim 1, wherein fuel is directed from said fluid supply line into said ports at a plurality of locations including locations spaced more upstream from others of said locations.

5. The fuel injection array as set forth in claim 1, wherein said swirler injectors including a fuel injector delivering fuel at a radially outer location and a radially inner location.

6. The fuel injection array as set forth in claim 1, wherein said bluff body injectors and said swirler injectors are circumferentially interspaced about a central axis.

7. The fuel injection array as set forth in claim 1, wherein said control controlling the flow of fuel to said bluff body injectors and said swirler injectors.

8. A fuel injection array for a gas turbine engine comprising:

a plurality of bluff body injectors and a plurality of swirler injectors;

a control for operating said plurality of bluff body injectors and said swirler injectors such that said bluff body injectors are utilized without all of the swirler injectors at least at low power operation, and said swirler injectors are utilized with said bluff body injectors at higher power operation;

said bluff body injectors include a central flow passage leading to a pilot port communicating fuel directly into a combustion chamber, said bluff body injectors also communicate fuel into locations upstream of the combustion chamber where the fuel is mixed with air prior to it reaching the combustion chamber; and said bluff body injectors and said swirler injectors are circumferentially interspaced about a central axis.

9. The fuel injection array as set forth in claim 8, wherein a fuel supply line leads into said central flow passage, and ports extend from said fuel supply line to locations on opposed sides of said central flow passage to intermix with air flowing along said opposed sides.

10. The fuel injection array as set forth in claim 9, wherein fuel is directed in a plurality of directions from said ports.

11. The fuel injection array as set forth in claim 9, wherein fuel is directed from said fluid supply line into said ports at a plurality of locations including locations spaced more upstream from others of said locations.

* * * * *